United States Patent [19]

Dietrich

[11] 4,109,339

[45] Aug. 29, 1978

[54] TOOTHBRUSH WITH CURVED HANDLE

[76] Inventor: Ursula Dietrich, 1588 Wedgewood, Hillsborough, Calif. 94010

[21] Appl. No.: 831,579

[22] Filed: Sep. 8, 1977

[51] Int. Cl.[2] ..... A46B 5/02

[52] U.S. Cl. ..... 15/167 R; 15/143 R; D4/25

[58] Field of Search ..... 15/110, 167 R, 167 A, 15/143 R–145; D4/24–36; 128/62 A

[56] References Cited

U.S. PATENT DOCUMENTS 2,094,240 9/1937 Herrick et al. ..... 15/167 R

FOREIGN PATENT DOCUMENTS 715,589 9/1931 France ..... 15/167 R 584,669 11/1958 Italy ..... 15/167 A

*Primary Examiner*—Peter Feldman

*Attorney, Agent, or Firm*—Townsend and Townsend

[57] ABSTRACT

A toothbrush adapted for brushing the teeth of a person or an animal. The handle is cross-sectionally flattened, is S-shaped in orthogonal lateral planes, and is longitudinally twisted to provide an improved grip. The curved handle positions the head at a twisted angle which enables the user to introduce the brush into the mouth of a person, such as a child, or an animal from the side of the mouth. The curved handle also makes it easier to brush the lingual surfaces of the teeth.

7 Claims, 9 Drawing Figures

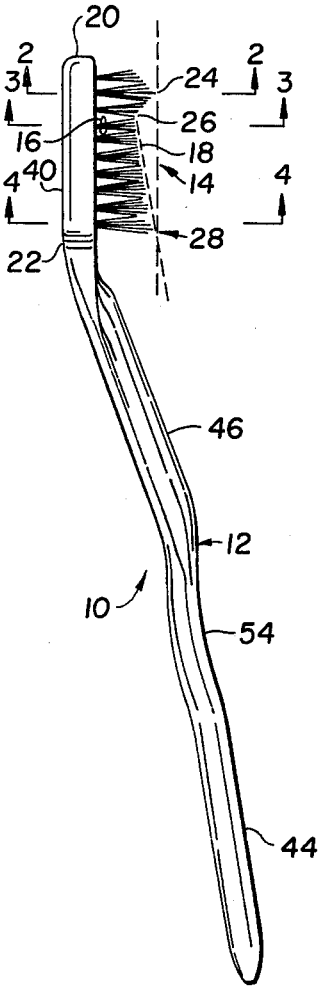
FIG._1.
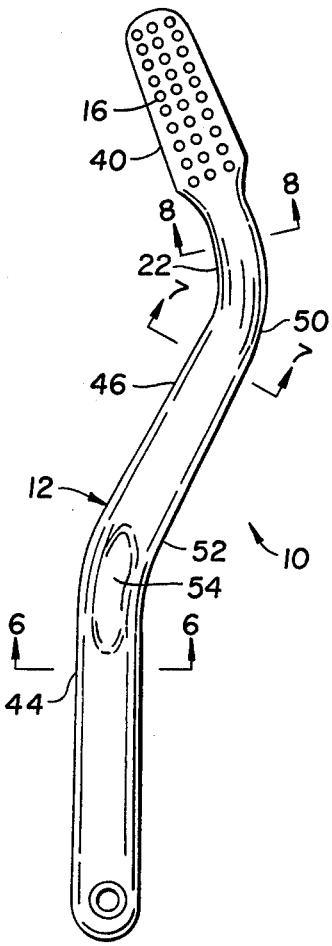
FIG._5.
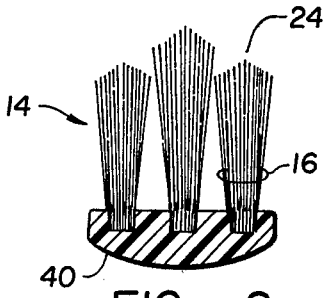
FIG._2.
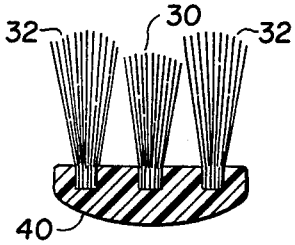
FIG._3.
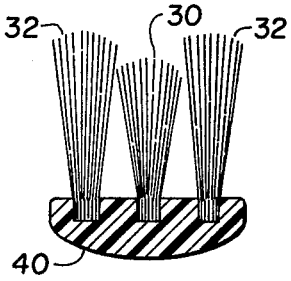
FIG._4.
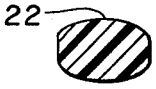
FIG._8.
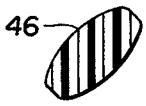
FIG._7.
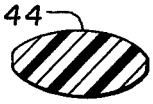
FIG._6.
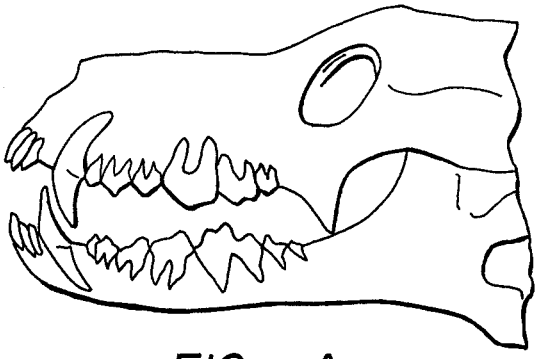
FIG._A.

TOOTHBRUSH WITH CURVED HANDLE

BACKGROUND OF THE INVENTION

This invention relates to a toothbrush adapted to be used to brush the teeth of another such as a child or an animal. Specifically, the invention is described and discussed as it would apply to the brushing of the teeth of a canine.

Like people, animals such as dogs and cats can benefit from a regular schedule of teeth cleaning in order to prevent periodontitis, particularly in the later years of life. The problem of gum irritation is even more severe with dogs than with humans, since canine saliva is more viscous and has a higher PH, and deposits of calculus are more likely to build up on the animal's teeth.

The common treatment for removing deposits from a dog's teeth is scaling by a veterinary. Employing a veterinary is prohibitively expensive on a frequent basis. Moreover, the scaling results in roughened surfaces, which accelerates the buildup of calculus. Furthermore, in the period between treatments, the breath of the animal rapidly becomes and remains unpleasant. There is now available a toothpaste devised for dogs. See U.S. Pat. No. 4,022,879 issued May 10, 1977. Furthermore, a toothbrush for canines has recently been disclosed which utilizes a uniquely shaped head specially adapted for the canine dental structure. See U.S. Pat. No. 4,031,587 issued June 28, 1977. Both of the inventions are by the inventor of the present invention. In order to ensure that the brushing is efficient and that all teeth of the animal or child are subjected to brushing and debris removal, it is necessary to provide a brush which is more easily held by the human hand in a position and at an angle which makes it easier to get the cooperation of the animal or child.

In the particular case of a dog, the jaws and teeth are different from those of a human. Refer to FIG. A of the accompanying drawings for purposes of illustration. A dog's teeth are primarily for tearing. The canine arch is trapezoidal in shape, unlike the human arch which is more parabolic. As viewed from the side, the canine arch has a reversed curve, rising and dropping from the first to the fourth bicuspid and then swinging upwards to the third molar. In contrast to human teeth, canine teeth have secondontal crowns, with sharp tips and sharp ridges, which function as tearing surfaces.

The toothbrush employed for humans is adapted to the conformation of the human mouth, and particularly the handle is adapted for brushing one's own teeth. Little attention has been given to the problem of brushing someone else's teeth, particularly to the unique configuration needed to brush the teeth of an animal. The different geometry, spacing and formation of canine teeth make the ordinary toothbrush inadequate to provide the mechanical brushing of the canine tooth surfaces and the removal of debris in the spaces between the teeth. There is, therefore, a need for a simple and effective toothbrush adapted especially to the conformation of the canine jaw and the spatial relationship of the teeth as well as to the special problems of administering a toothbrushing to any small animal or human.

SUMMARY OF THE INVENTION

In order to overcome the problems hereinabove described, a toothbrush is provided which is adapted for brushing the teeth of another such as a child, a dog or a cat. In specific embodiment, the toothbrush is adapted to conform to the shape of the jaw and the teeth therein. The toothbrush includes a shaped handle adapted to the different positioning of the person who is performing the brushing. The handle is cross sectionally flattened to accommodate the bristles as well as the human hand. The handle is also S-shaped in orthogonal planes and includes a longitudinal twist to accommodate the thumb of the human hand in an improved grip.

In a further particular embodiment adapted for brushing the tooth of a canine, a specialized head may be employed, as disclosed in U.S. Pat. No. 4,031,587. The disclosure of that patent is incorporated herein by reference. The shape of the brush together with the shape of the handle promotes the simultaneous cleaning of the cuspid-type and molar-type teeth in a long narrow jaw and makes it easier to get cooperation by introducing the brush from the side of the mouth. The curved handle makes it particularly easy to brush the lingual surfaces of the teeth.

BRIEF DESCRIPTION OF THE DRAWINGS

FIG. A, previously referred to, is a side view of the jaws and teeth of a dog;

FIG. 1 is a side view of a toothbrush according to the invention;

FIG. 2 is a cross sectional view along the line 2—2 of FIG. 1;

FIG. 3 is a cross sectional view along the line 3—3 of FIG. 1;

FIG. 4 is a cross sectional view along the line 4—4 of FIG. 1;

FIG. 5 is a front view of the brush of FIG. 1;

FIG. 6 is a cross sectional view of FIG. 5 along line 6—6;

FIG. 7 is a cross sectional view of FIG. 5 along line 7—7; and

FIG. 8 is a cross sectional view of FIG. 5 along line 8—8.

DETAILED DESCRIPTION OF THE SPECIFIC EMBODIMENT

Referring to FIG. 1, a toothbrush 10 according to the present invention is shown which is particularly suitable for efficient cleaning of an animal's teeth as previously described. The toothbrush 10 comprises a handle 12 and a head 14 comprising turfts 16 of soft bristles 18 attached to the handle 12 between the handle top 20 and a neck 22.

An important feature of the invention is the shape of handle 12, as described in conjunction with FIGS. 1, 5, 6, 7 and 8.

The handle 12 may be subdivided into four segments. Referring to FIGS. 1 and 5, the handle 12 comprises a head segment 40, to which head 14 is attached, the neck segment 22, a grip segment 44 and a shaft segment 46. The neck segment 22 is an extension of the head segment 40. The shaft segment 46 links neck 22 and grip 44.

FIG. 5 illustrates a brush 10 viewed from the bristle side shaped to accommodate use by a right-handed person. A left-handed brush would be in the mirror image of FIG. 5. Viewed in the plane of FIG. 5, the handle 12 is of a reverse S-shape. That is, the handle, from 20 to bottom is curved first to the left, then back to the right. The angles of the bend of the curves may be from about 120° to about 150° and are preferably about 135°.

In FIG. 1, showing the lateral plane orthogonal to the plane of FIG. 5, it is seen that the handle 12 is also laterally offset. That is, the head segment 40 is bent forward at neck 22 and the grip 44 is bent slightly backward. The angle at neck 22 may be about 150° to 170° and preferably about 160°.

In lateral cross section, the handle 12 is flattened, particularly at the head segment 40 as shown in FIGS. 2, 3 and 4, as well as along the neck, shaft and grip 40, 46 and 44, as shown in FIGS. 6, 7 and 8.

Specifically, at the neck 22 (FIG. 8), the cross section is double convex with truncated edges. At the shaft (FIG. 7), the cross section is broadened relative to the neck, but retaining the same general shape. However, viewed from the grip end, the shaft segment 46 is twisted counterclockwise between about point 50 and point 52. At the maximum, namely at the cross section of FIG. 7, the shaft is twisted between about 30° and 60°, and preferably about 45°.

Between point 52 and the cross section of FIG. 6 at grip 44, the shaft is reverse twisted, i.e., clockwise, to an orientation parallel to the cross section of the neck 22. The twist and reverse twist thereby form as it were, banks along the outer radii of the double curves on the bristle side of the handle 12.

Furthermore, the handle 12 forms a depression 54 on the bristle side thereof between point 52 and the grip 44. Depression 54 is for accommodating the thumb of a gripping hand to enable a user to hold the brush 10 more securely. Similarly, the twist of shaft 46 is for accommodating the forefinger of the gripping hand, enabling the user to comfortably rest the side of the forefinger on shaft 46, as it may be convenient, while cleaning the teeth and gums in the mouth of an animal such as a dog or a cat.

In a particular embodiment adapted for use of canines, as shown in FIGS. 2, 3 and 4, the head 14 comprises three rows of tufts 16 along the axis of the handle 12, the tufts defining a trough 30 with side ridges 32 which culminate in a narrowed peak 24.

In use, a forward and backward motion of the toothbrush in the above orientation scrubs the table of the rear molars, where debris frequently accumulates, and scrubs the top and sides for the forward teeth. The shape of the handle facilitates the brushing of teeth on the inside (lingual side). While one hand is holding the animal's head, the other can introduce the brush easily into the mouth and move from one side to the other. The central trough 30 of the brush head 14 confronts the relatively long, thin forward teeth, the sides of the ridges 32 of the brush head 14 confront the sides of the same teeth and also scrub the sides of the teeth, including the gum line. The peak 24 of the brush head 14 is also useful in cleaning between and directly behind the cuspid teeth where there is a large gap. The shape of the brush handle 12 also permits the brush head 14 to more readily reach the areas on the tops and sides of the rear molars which are otherwise relatively difficult to reach.

A toothbrush according to the present invention may be manufactured in assorted sizes suitable to the size of the mouth of the animal or child. The bristles 18 may be embedded in the handle 12 in a conventional manner in tufts of approximately twelve bristles each. The bristles may be of such suitable material as nylon strands 0.007 inches in diameter. The handle 12 may be of any suitable length, for example, approximately 15 cm. The handle need not be so long as to minimize the danger to the user of being bitten if the toothbrush is used with the canine dentifrice now available which particularly adapts to the animal's tastes.

With the invention thus explained, it will be apparent that obvious modifications and adaptions can be made without departing from the scope of the invention. It is therefore intended that the invention be limited only as indicated by the appended claims.

I claim:

1. A toothbrush for cleaning the teeth of another person or animal, comprising a handle and a head attached to said handle, said handle having a top end and a bottom end and an intermediate neck, said handle having a generally elliptical cross section with a bristle side and including a head segment, a neck segment adjacent said head segment, a grip segment and a shaft segment connecting said grip segment and said neck segment, said neck segment being laterally offset in a double curve from said grip segment along said shaft segment, said shaft segment defining a longitudinal twist in one direction and, at an adjacent portion along said shaft segment, a twist in the opposite direction between said neck segment and said grip segment, wherein outer radii of said double curve define banks on said bristle side, said shaft segment further defining a depression on said bristle side adjacent said grip segment, said depression being adapted to receive a thumb for improving hand grasp of the toothbrush, such that said curved handle facilitates the introduction of said toothbrush into the side of the mouth of the animal or child whose teeth are being brushed.

2. A toothbrush according to claim 1 wherein said neck segment defines a first lateral curve at one end of said shaft segment and wherein said shaft segment defines a second lateral curve the reverse of said first lateral curve at said depression.

3. A toothbrush according to claim 2 wherein said shaft segment defines a third lateral curve in a plane orthogonal to said first lateral curve.

4. A toothbrush adapted for cleaning the teeth of another animal or person, said toothbrush comprising a handle and a head attached to said handle, said handle having a bristle side and including a head segment, a neck segment adjacent said head segment, a grip segment and a shaft segment connecting said grip segment and said neck segment, said neck segment being laterally offset in a double curve from said grip segment along said shaft segment, said shaft segment defining a longitudinal twist in one direction and, at an adjacent portion along said shaft segment, a twist in the opposite direction between said neck segment and said grip segment wherein outer radii of said double curve define banks on said bristle side, said shaft segment further defining a depression on said bristle side adjacent said grip segment adapted to receive a thumb for improving the hand grasp of the brush handle.

5. A toothbrush according to claim 4 wherein said head comprises at least three rows of longitudinally extending bristles defining longitudinally a peak adjacent said top end, a heel adjacent said neck segment, and a substantially linear incline from said heel to the foot of said peak, said incline having a maximum height at said heel substantially corresponding to the maximum height of said peak, and a minimum height at the foot of said peak, said head further defining in cross section along said linear incline from said heel to the foot of said peak a central longitudinal trough of bristles of uniform diminished height relative to longitudinal outside rows of bristles defining said incline, the tops of said peak bristles defining surfaces for confronting the tables of the molars at the rear of said jaw, the tops and sides of the outside longitudinal bristle rows of said incline defining surfaces for confronting gums and side faces of secondontal crowned teeth and the tops and sides of the bristles of said central trough defining surfaces for confronting secondontal crowned teeth, said trough further defining a guideway for tracking the tops of said crowned teeth along the jawline upon confrontation between the tops of bristles defining said peak and the tables of the rear molar section, so that longitudinal translation of said brush head scrubs and massages the gums and the tops and sides of the teeth.

6. A toothbrush according to claim 5, wherein said bristles at said peak define a narrowed point centered along said trough.

7. A toothbrush according to claim 5 wherein said bristles at said peak are of substantially uniform maximum height, the bristles from the top and up to the peak, and down to the foot of said peak being of uniform length and cross section.

* * * * *